US009263837B2

(12) United States Patent
Shi et al.

(10) Patent No.: US 9,263,837 B2
(45) Date of Patent: Feb. 16, 2016

(54) ELECTRICAL CONNECTOR WITH IMPROVED CONTACT ARRANGEMENT

(71) Applicant: HON HAI PRECISION INDUSTRY CO., LTD., New Taipei (TW)

(72) Inventors: Xian-Kui Shi, Shenzhen (CN); Yong-Jun Chen, ShenZhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/251,912

(22) Filed: Apr. 14, 2014

(65) Prior Publication Data

US 2014/0308848 A1 Oct. 16, 2014

(30) Foreign Application Priority Data

Apr. 12, 2013 (CN) ..... 2013 2 0183188

(51) Int. Cl.
*H01R 24/00* (2011.01)
*H01R 24/62* (2011.01)
*H01R 13/6581* (2011.01)

(52) U.S. Cl.
CPC ..... *H01R 24/62* (2013.01); *H01R 13/6581* (2013.01)

(58) Field of Classification Search
CPC ..... H01R 13/6581; H01R 24/62
USPC ..... 439/607.55, 607.1, 660, 607.48, 439/607.47, 607.41
See application file for complete search history.

(56) References Cited

U.S. PATENT DOCUMENTS 7,104,842 B1 * 9/2006 Huang ..... H01R 13/65802 439/352
7,559,805 B1 7/2009 Yi et al.
7,670,181 B2 * 3/2010 Tu ..... H01R 13/6456 439/607.01
8,011,968 B2 * 9/2011 Lai ..... H01R 13/65802 439/660
8,079,854 B2 * 12/2011 He et al. ..... 439/108
8,100,725 B2 * 1/2012 Su ..... H01R 27/00 439/660

(Continued)

*Primary Examiner* — Abdullah Riyami
*Assistant Examiner* — Nader J Alhawamdeh
(74) *Attorney, Agent, or Firm* — Ming Chieh Chang; Wei Te Chung

(57) ABSTRACT

An electrical connector includes an insulative housing defining a receiving space (110), a number of contacts retained in the insulative housing, a cable (6) electrically connected with the contacts, and a shielding member (5) enclosing on the insulative housing to form a cavity (120). The contacts comprise a set of first contacts (2) and a set of second contacts (3), each of the first and second contacts having a contacting portion and a tail portion. The cavity has a smaller length than the receiving space along a transverse direction, the cavity is stacked on one side of the receiving space along an up-to-down direction, the cavity has a lateral boundary coplanar with the receiving space, the second contacts are received in the receiving space, and the first contacts are retained in the cavity for transmitting high speed signal.

12 Claims, 7 Drawing Sheets

(56) References Cited

U.S. PATENT DOCUMENTS

| | | | | |
|---|---|---|---|---|
| 8,113,882 | B1 | 2/2012 | Chen | |
| 8,246,388 | B2 * | 8/2012 | Chen | H01R 12/724 439/660 |
| 8,292,637 | B2 * | 10/2012 | Wu | H01R 13/5825 439/607.55 |
| 8,333,616 | B2 * | 12/2012 | Su | H01R 13/6581 439/607.41 |
| 8,517,766 | B2 * | 8/2013 | Golko | H01R 13/516 439/607.41 |
| 2010/0093217 | A1 * | 4/2010 | Shi | H01R 13/6581 439/607.41 |
| 2010/0248537 | A1 * | 9/2010 | Zhou | H01R 13/74 439/571 |
| 2011/0028046 | A1 * | 2/2011 | Wang | H01R 24/60 439/660 |
| 2011/0034080 | A1 * | 2/2011 | Su | H01R 27/00 439/607.01 |
| 2011/0151716 | A1 * | 6/2011 | Kondo | H01R 13/6658 439/607.01 |
| 2011/0201215 | A1 * | 8/2011 | Matsubara | H01R 13/6597 439/55 |
| 2012/0028495 | A1 * | 2/2012 | Su | H01R 9/03 439/449 |
| 2012/0171903 | A1 * | 7/2012 | Wang | H01R 13/508 439/660 |
| 2012/0214350 | A1 * | 8/2012 | Wu | H01R 13/5812 439/676 |
| 2014/0213109 | A1 * | 7/2014 | Wu | H01R 24/62 439/607.01 |
| 2015/0050836 | A1 * | 2/2015 | Wu | H01R 13/4367 439/607.01 |
| 2015/0056839 | A1 * | 2/2015 | Zhang | H01R 13/6581 439/350 |
| 2015/0068803 | A1 * | 3/2015 | Wu | H01R 13/4367 174/94 R |

* cited by examiner

ELECTRICAL CONNECTOR WITH IMPROVED CONTACT ARRANGEMENT

BACKGROUND OF THE INVENTION

1. Field of the Invention

The present invention relates to an electrical connector, and more particularly to an electrical connector having improved contacts arrangement.

2. Description of Related Art

Universal Serial BUS (USB) is a widely used input/output interface adapted for many electronic devices, such as personal computers and related peripherals. Nowadays, USB-IF has published several specification editions for USB, and transmitting rate of USB has become higher and higher. As electronic industry develops, higher transmitting rate of USB based connection accessory is needed.

A USB 3.0 specification over USB 2.0 has been adopted for transmitting high speed data. A USB 3.0 connector has five additional contacts for high speed signal transmission. A USB 3.0 connector of Powered-B type has two lateral contacts, one of the two lateral contacts being a power contact, and the other one being a ground contact. The power contact can supply power for peripheral equipment connected with the USB 3.0 connector of Powered-B type, without the need of additional power supply. However, some electronic devices, such as game consoles, require a large current flow, making the power supply system of the electronic device unstable.

Hence, an electrical connector with improved contacts is desired to overcome the above problems.

BRIEF SUMMARY OF THE INVENTION

According to one aspect of the present invention, an electrical connector comprises: an insulative housing defining a receiving space, a plurality of contacts retained in the insulative housing, a cable electrically connected with the contacts, and a shielding member enclosing on the insulative housing to form a cavity. The contacts comprise a set of first contacts and a set of second contacts, each of the first and second contacts having a contacting portion and a tail portion. The cavity has a smaller length than the receiving space along a transverse direction, and the cavity is stacked on one side of the receiving space along an up-to-down direction, the cavity has a lateral boundary coplanar with the receiving space, the second contacts are received in the receiving space, the first contacts are retained in the cavity to transmitting high speed signal.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
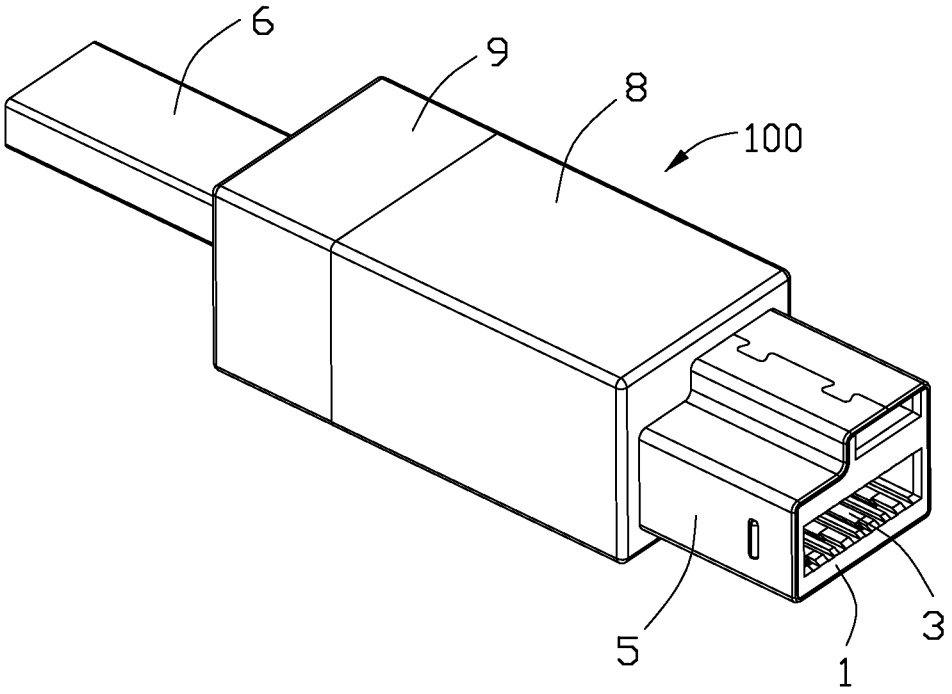
FIG. 1 is a perspective assembled view of an electrical connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-4, an electrical connector 100 according to a preferred embodiment of the present invention includes an insulative housing 1, a plurality of first and second contacts 2, 3 retained in the insulative housing 1, a spacer 4 assembled to the insulative housing 1 for retaining the first and second contacts 2, 3, a shielding member 5 enclosing on the insulative housing 1, a cable 6 electrically connected with the first and second contacts 2, 3, an inner insulator 7 molded on an electrical connection between the cable 6 and the first and second contacts 2, 3, a front cover 8, and a back cover 9 over-molded on the cable 6.

Referring to FIGS. 3-7, the insulative housing 1 is molded of dielectric material such as plastic or the like, and includes a main portion 11, an extension portion 12 extending upwards from a top surface of the main portion 11, and a pair of positioning posts 13 extending rearwards from a back end surface of the main portion 11. A receiving space 110 is formed by four conjunctive walls of the main portion 11, and extending along a mating direction of the electrical connector 100. The main portion 11 has a plurality of passageways 112 communicating with the receiving space 110, and four of the passageways 112 are recessed downwardly from an inner surface of a bottom wall of the main portion 11, the remaining four passageways 112 are recessed upwardly from an inner surface of a top wall of the main portion 11. Each positioning post 13 is a tiny column extending along a horizontal direction.

The extension portion 12 is defined on one side of the main portion 11 along a transverse direction, thus the extension portion 12 together with the main portion 11 are forming an L-shaped configuration. The extension portion 12 has a smaller height than the main portion 11 along a vertical direction. Simultaneously, the extension portion 12 has a dent 121 depressed downwards from an upper surface thereof, and the dent 121 is on a front segment of the extension portion 12. The extension portion 12 defines a plurality of slots 122 extending along the mating direction, front parts of the slots 122 are arranged in the dent 121 and communicated with an exterior in the vertical direction.

The first contacts 2 include two pairs of differential contacts and a grounding contact for transmitting high speed signal, the arrangement of the first contacts 2 is in accordance with USB 3.0 standard. The grounding contact is located between the two pairs of differential contacts to suppress cross-talk. Each first contact 2 comprises a resilient contacting portion 21, a tail portion 23, and a connecting portion 22 connecting the contacting portion 21 with the tail portion 23. Tail portions 23 of the first contacts 2 is arranged on a first level along the horizontal direction, two outer pairs of tail portions 23 are deflecting outwardly relative to the tail portion of the middle grounding contact, thus to increase the distance between the two neighboring tail portions 23. The first contacts 2 are received in the corresponding slots 122 of the extension portion 12.

Each of the second contacts 3 includes a stiff contacting portion 31, a retaining portion 32 extending backwards from corresponding contacting portion 31, and a tail portion 33 on a back end thereof. Each contacting portion 31 has a tapered end portion 311 on a front end thereof, a bending portion 34 is defined between the retaining portion 32 with the tail portion 33. The second contacts 3 are labeled as 3*a* to 3*h* in sequence, the contacting portions 31 of the second contacts 3 are arranged in two horizontal rows, and tail portions 33 of the second contacts 3 are arranged on a second level along the horizontal direction. The second contacts 3 with upper contacting portions 31 are labeled as 3*a*, 3*b*, 3*c*, 3*d* from left to right, and comprise a power contact 3*a*, a negative signal contact 3*b*, a positive signal contact 3*c*, and a grounding contact 3*d*. The second contacts 3 with lower contacting portions 31 are labeled as 3*e*, 3*f*, 3*g*, 3*h* along a right to left direction, and comprise a DPWR (Power provided by device) contact 3*e*, a pair of grounding contacts 3*f*, 3*g* (Ground return to DPWR) sharing a common tail portion, and a spare contact 3*h*. The pair of grounding contacts 3*f*, 3*g* are linked together with each other by a conjoining portion 35 connecting two bending portions 34 of the two contacts.

The spacer 4 is assembled to the back end surface of the insulative housing 1, and comprises a front engaging portion 41 and a back supporting portion 42. The engaging portion 41 defines a pair of holes (not labeled) in a front surface thereof for retaining the corresponding positioning posts 13. The supporting portion 42 defines a plurality of grooves 421 on a top surface and a bottom surface thereof, to receive corresponding tail portions 23, 33. After the first contacts 2 and the second contacts 3 assembled to the insulative housing 1, tail portions 23, 33 are exposed beyond the back end surface of the insulative housing 1 and inserted into the grooves 421 of the spacer 4. The cable 6 is electrically connected with the first and the second contacts 2, 3.

The shielding member 5 is made of metallic material, and includes a first shell 51 and a second shell 52 cooperated with each other. The second shell 52 is stamped from a unitary one-piece metal sheet, and comprises a tube portion 520 enclosing the main portion 11 and a drawer portion 521 extending backwardly from the tube portion 520 for latching with the first shell 51. The tube portion 520 has an L-shaped cross-section view, and the tube portion 520 has two different heights along the transverse direction, thus to form a depression 522. The first shell 51 has a pair of resilient tabs 511 on a front end thereof, and the pair of resilient tabs 511 are located on one side corresponding to the extension portion 12 of the insulative housing 1, a shielding sheet 512 is defined on another side of the first shell 51.

The first contacts 2 are assembled in the corresponding slots 122 of the insulative housing 1, the second contacts 3 are assembled in the corresponding passageways 112 of the insulative housing 1. The contacting portions 31 of the second contacts 3 are divided into two groups on different horizontal levels, and each group of the second contacts 3 at least has one contacting portion 31 closer to a front end of the insulative housing 1 than others.

The spacer 4 is attached to the back end surface of the insulative housing 1, the positioning posts 13 of the insulative housing 1 are inserted into the corresponding holes of the spacer 4. Then the insulative housing 1 is assembled to the second shell 52, a cavity 120 is formed by the extension portion 12 of the insulative housing 1 and an upper wall of the second shell 52, and the cavity 120 is located above on one side of the receiving space 110, the cavity 120 has a smaller length than the receiving space 110 along the transverse direction, the cavity 120 confined between opposite two side walls (not labeled) in the transverse direction and has a lateral boundary on the outer side wall along the vertical direction, and the lateral boundary is coplanar with a same side boundary of the receiving space 120. The first contacts 2 are arranged in the cavity 120, and the second contacts 3 are placed in the receiving space 110. Understandably, the opposite side walls by two sides of the cavity 120 may protect the resilient first contacting portions therebetween in the transverse direction. The first shell 51 is assembled to the drawer portion 521 of the second shell 52, the inner insulator 7 is molded on rear segments of the first and second shell 51, 52, and enclosed on a front part of the cable 6. The resilient tabs 511 of the first shell 51 are inserted apertures (not labeled) of the second shell 52. The shielding sheet 512 of the first shell 51 is bent down from the front end of the first shell 51, and accommodated in the depression 522 of the second shell 52 along the vertical direction.

Figure 2:
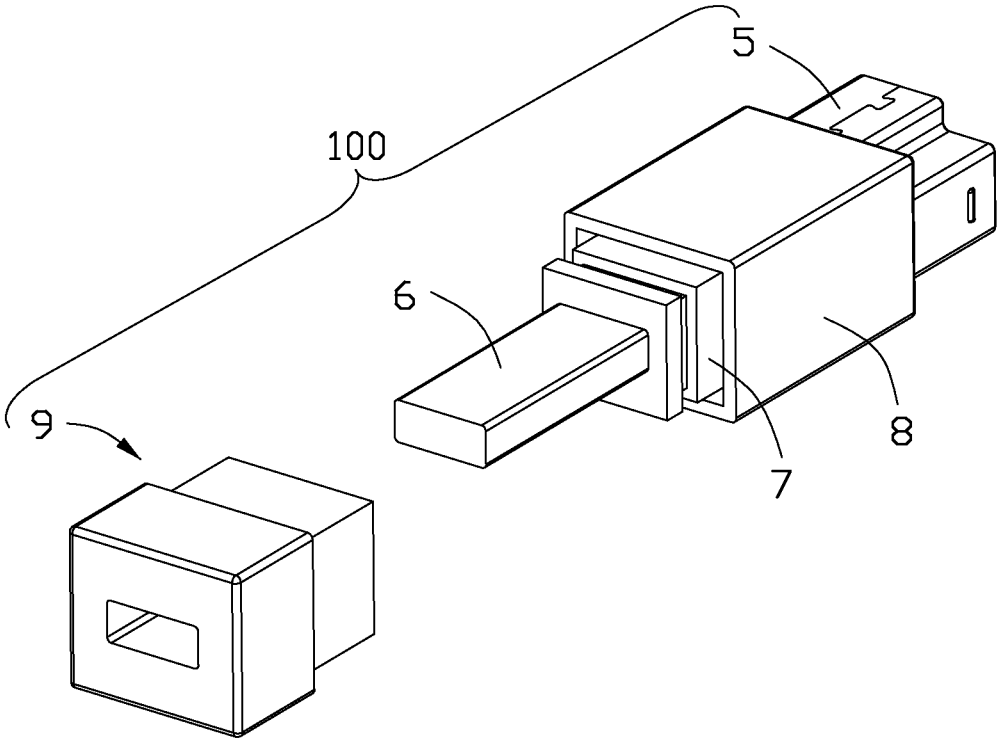
FIG. 2 is a partly exploded view of the electrical connector shown in FIG. 1.
Figure 3:
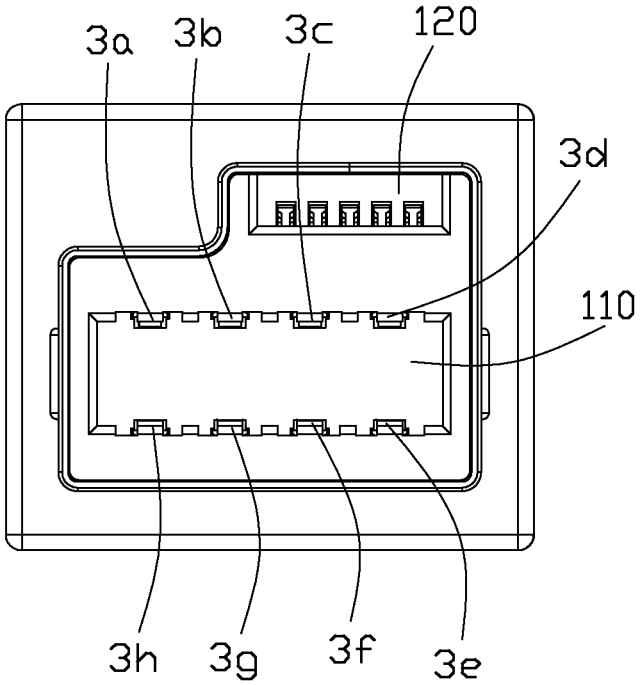
FIG. 3 is a front elevational view of the electrical connector shown in FIG. 1.
Figure 4:
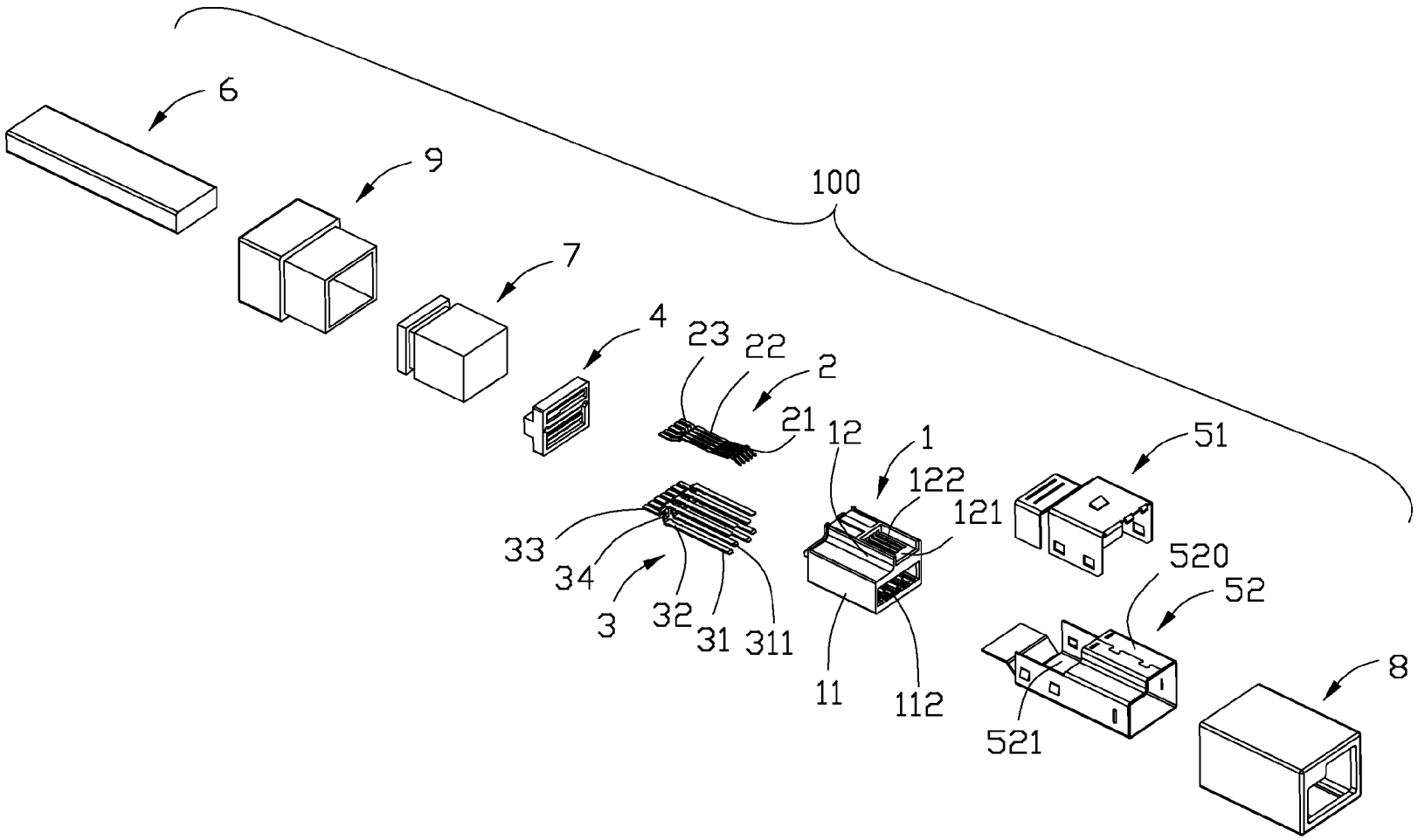
FIGS. 4-5 are exploded views of the electrical connector shown in FIG. 1.
Figure 5:
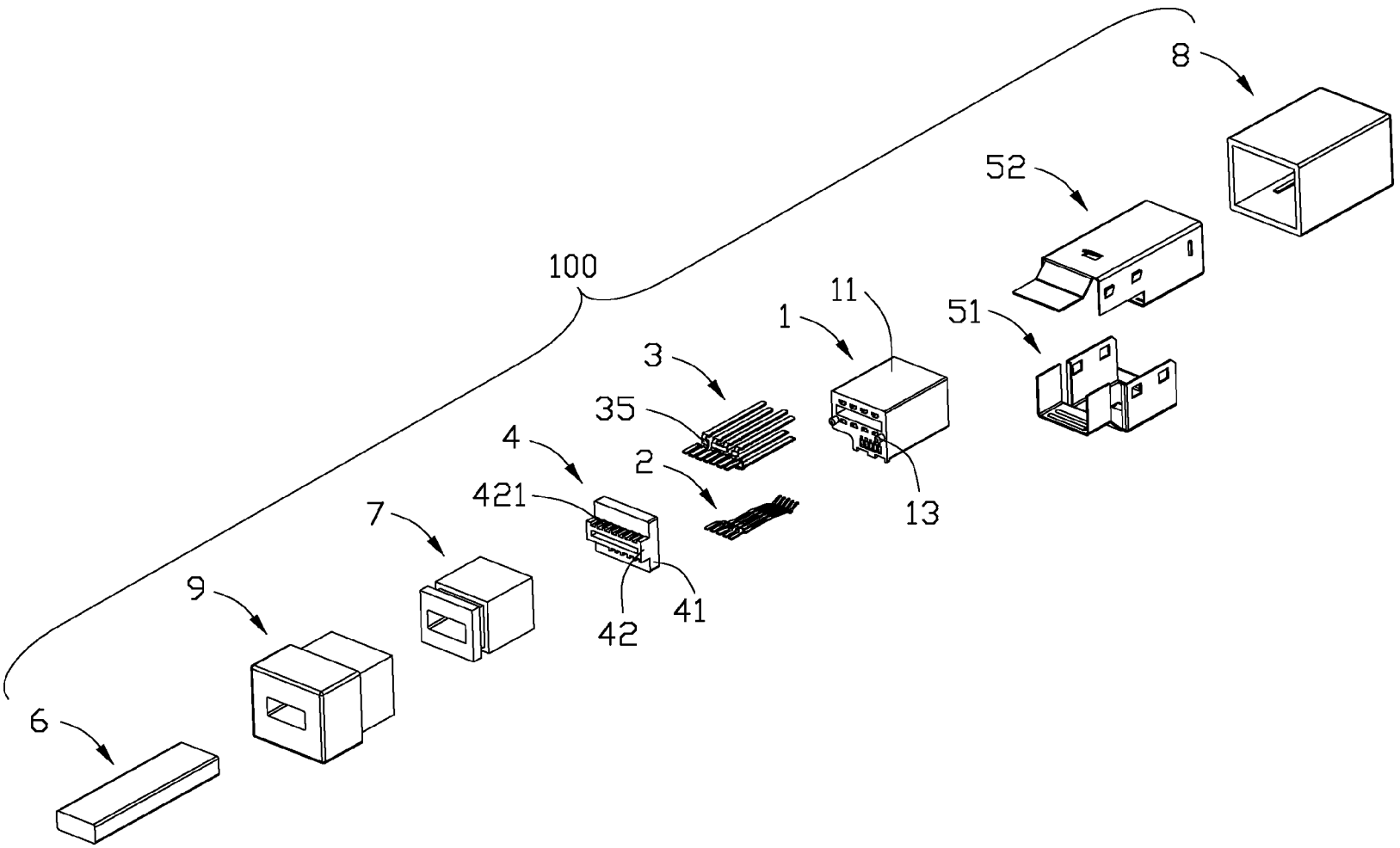
Figure 6:
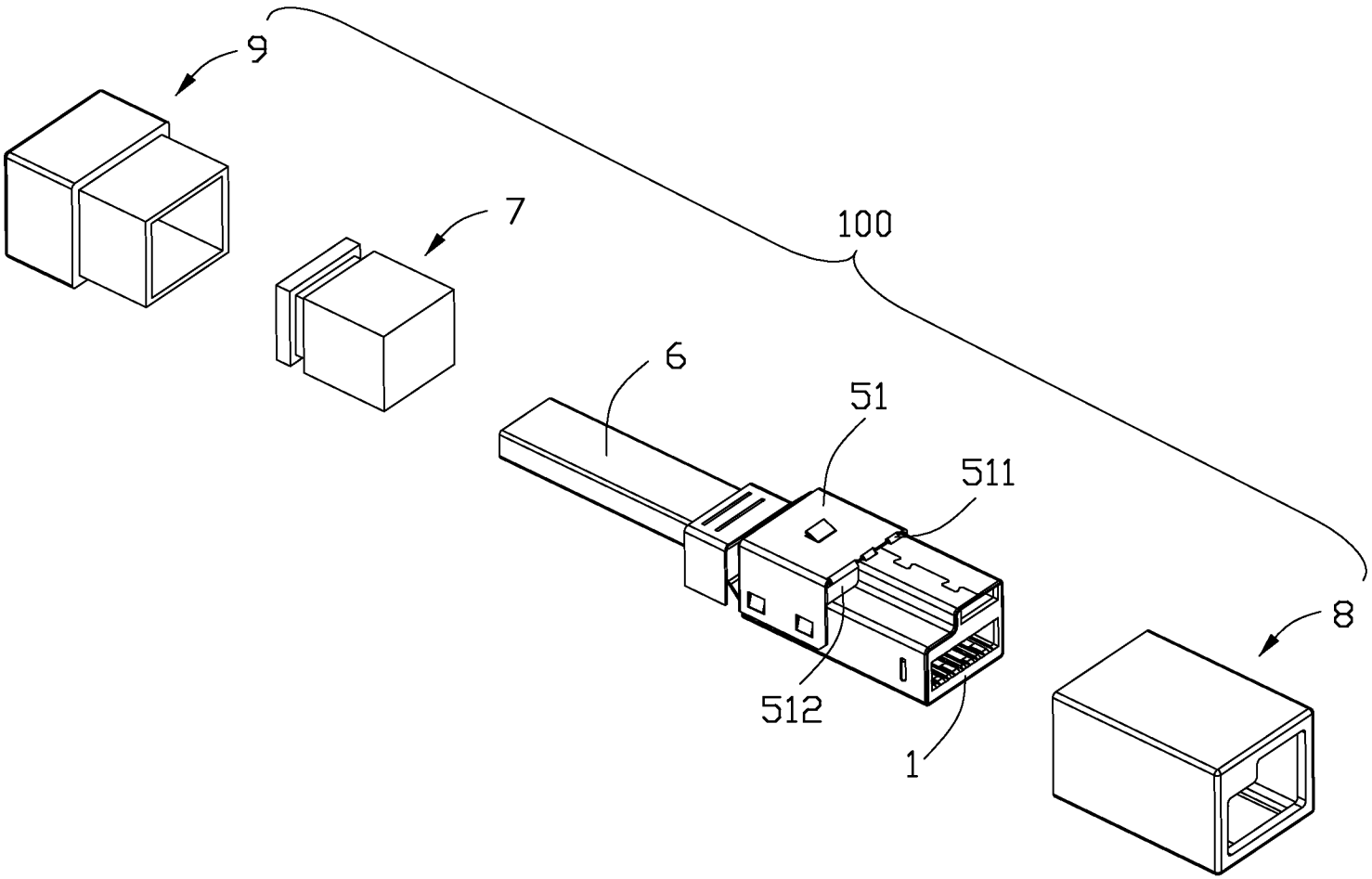
FIG. 6 is a partly assembled view of the electrical connector shown in FIG. 4.
Figure 7:
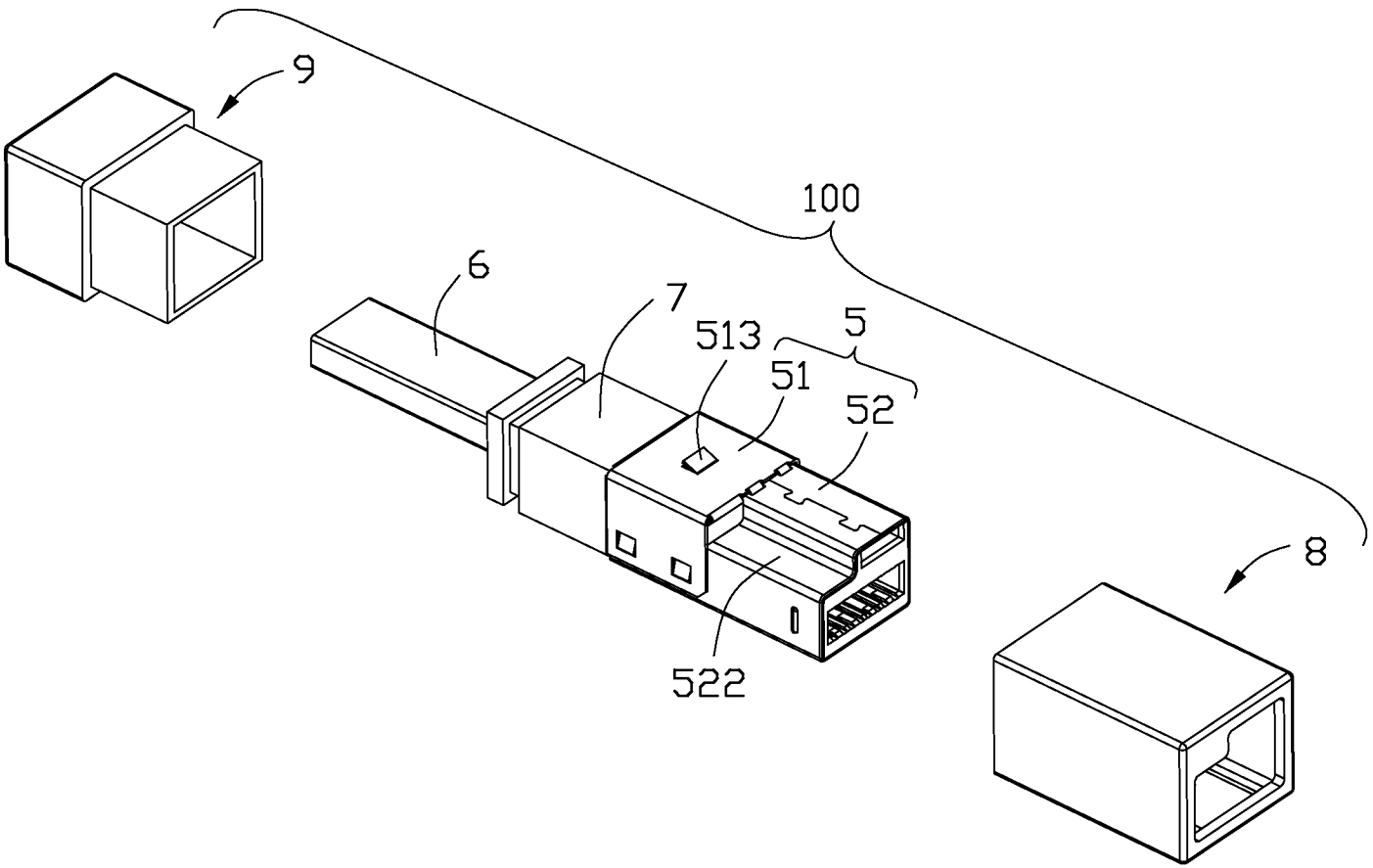
FIG. 7 is a further assembled view of the electrical connector shown in FIG. 6.

Referring to FIGS. 1-2, the front cover 8 is made of insulative material, and assembled on the shielding member 5 and the inner insulator 7 along a front to back direction, a front end of the front cover 8 is located in front of and adjacent to the shielding sheet 512 of the first shell 51. A pair of locking portions (not shown) defined on two opposite walls of the front cover 8 are cooperated with corresponding latching tabs 513 on the shielding member 5. The back cover 9 is overmolded on the cable 6 and the inner insulator 7, and a front section of the back cover 9 is received in the front cover 8, a back section of the back cover 9 is adjacent to a rear end of the front cover 8 to form a zero clearance fit.

The second contacts 2 of the present invention can transmit larger current, such as can work normally in an environment of 9 volts to ensure system stability.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing defining a receiving space;

a plurality of contacts retained in the insulative housing, the contacts comprising a set of first contacts and a set of second contacts, each of the first and second contacts having a contacting portion and a tail portion;

a cable electrically connected with the contacts; and a shielding member enclosing on the insulative housing to form a cavity; wherein:

the cavity has a smaller length than the receiving space along a transverse direction;

the cavity is stacked on one side of the receiving space along an up-to-down direction;

the cavity has a lateral boundary coplanar with the receiving space;

the second contacts are received in the receiving space;

the first contacts are retained in the cavity for transmitting high speed signal;

the contacting portions of the second contacts are arranged in an upper row and a lower row and exposed in the receiving space;

at least one contacting portion of each row of the second contacts is closer to a front end of the insulative housing than others in a same row; and the second contacts in the upper row comprise, in sequence, a power contact, a negative signal contact, a positive signal contact, and a grounding contact, and wherein the second contacts of the lower row include a power contact, a pair of grounding contacts sharing a common tail portion, and a spare contact.

2. The electrical connector according to claim 1, wherein the tail portions of the second contacts are arranged on a horizontal level.

3. The electrical connector according to claim 1, wherein the insulative housing comprises a main portion and an extension portion extending upwards from a top surface of the main portion.

4. The electrical connector according to claim 1, wherein the shielding member includes a first shell and a second shell, and the first shell has a shielding sheet bent down from a front end thereof.

5. The electrical connector according to claim 4, wherein the second shell comprises a front tube portion and a drawer portion extending backwardly from the tube portion for latching with the first shell, the tube portion having an L-shaped cross-section.

6. The electrical connector according to claim 5, wherein the tube portion has two different heights along the transverse direction to form a depression, and the shielding sheet of the first shell is accommodated in the depression along the up-to-down direction.

7. The electrical connector according to claim 1, further comprising a spacer assembled to a back end of the insulative housing, and wherein the spacer defines a plurality of grooves on a top surface and a bottom surface thereof to receive corresponding tail portions of the contacts.

8. An electrical connector comprising:

an insulative housing defining opposite first and second side walls and opposite third and fourth side walls together forming a receiving space;

a plurality of first contacts disposed in the insulative housing and having first contacting portions exposed upon the first side wall and facing toward a shielding member; and a plurality of second contacts disposed in the insulative housing and having two groups of second contacting portions exposed in the first and second side walls, the two groups of second contacting portions facing toward each other; wherein each group of second contacts has four contacts arranged in a horizontal row, the insulative housing defines a main portion and an extension portion extending upwards from the main portion, and the extension portion and the main portion define an L-shaped configuration; and one group of said second contacts includes a power contact, a negative signal contact, a positive signal contact, and a grounding contact in sequence, and another group of the second contacts includes a power contact, a pair of grounding contacts sharing a common tail portion, and a spare contact.

9. The electrical connector as claimed in claim 8, wherein at least one of each group of the second contacting portions is closer to a front end of the insulative housing.

10. An electrical connector comprising:

an insulative housing forming a surrounded receiving space with an opening communicating forwardly with an exterior in a front-to-back direction, and a cavity located above and spaced from the receiving space in a vertical direction perpendicular to said front-to-back direction, said cavity defining an opening communicating forwardly with the exterior and an upward opening opposite to said receiving space in the vertical direction, said cavity being protectively confined between two opposite side walls in a transverse direction perpendicular to both said front-to-back direction and said vertical direction;

a metallic shell intimately enclosing said housing and covering said another opening;

one row of first contacts disposed in the housing with corresponding resilient first contacting portions exposed in the cavity and protectively hidden by the opposite side walls in the transverse direction; and two rows of second contacts disposed in the housing and opposite to each other; wherein the cavity is dimensioned smaller than the receiving space in the transverse direction; wherein a vertical center line of the cavity is offset from that of the receiving space; wherein said housing defines an L-shaped configuration in a front view along the front-to-back direction; wherein one lateral boundary of the cavity derived by the corresponding side wall, is aligned with another lateral boundary of the receiving space in the vertical direction; further comprising an inner insulator, a front cover, and a back cover engaging with each other along a mating direction, and wherein the inner insulator is molded on a rear segment of the shell, the back cover is over-molded on a cable, which is connecting to the first contacts and the second contacts, and the inner insulator, a front segment of the back cover is received in the front cover, and a rear segment of the back cover is adjacent to a rear end of the front cover to form a zero clearance fit.

11. The electrical connector according to claim 1, further comprising an inner insulator, a front cover, and a back cover engaging with each other along a mating direction, and wherein the inner insulator is molded on a rear segment of the shielding member, the back cover is over-molded on the cable and the inner insulator, a front segment of the back cover is received in the front cover, and a rear segment of the back cover is adjacent to a rear end of the front cover to form a zero clearance fit.

12. The electrical connector according to claim 8, further comprising an inner insulator, a front cover, and a back cover engaging with each other along a mating direction, and wherein the inner insulator is molded on a rear segment of the shielding member, the back cover is over-molded on a cable, which is connecting to the first contacts and the second contacts, and the inner insulator, a front segment of the back cover is received in the front cover, and a rear segment of the back cover is adjacent to a rear end of the front cover to form a zero clearance fit.

* * * * *